United States Patent [19]

Mihelich

[11] Patent Number: 4,669,162

[45] Date of Patent: Jun. 2, 1987

[54] METHOD AND APPARATUS FOR RAPIDLY STRIPPING CABLE WIRES AND CRIMPING CONTACTS THEREON

[75] Inventor: Peter J. Mihelich, West Corina, Calif.

[73] Assignee: Grumman Aerospace Corporation, Bethpage, N.Y.

[21] Appl. No.: 727,320

[22] Filed: Apr. 25, 1985

[51] Int. Cl.[4] ..... H01R 43/04

[52] U.S. Cl. ..... 29/33 M; 29/564.4; 29/566.2; 29/748; 29/857

[58] Field of Search ..... 29/564.6, 33 M, 564.3, 29/564.4, 564.8, 566.1, 566.2, 748, 749, 857, 861; 408/3

[56] References Cited

U.S. PATENT DOCUMENTS

| | | | |
|---|---|---|---|
| 2,768,425 | 10/1956 | Andren | 29/155.55 |
| 2,873,511 | 2/1959 | Folkenroth | 29/155.55 |
| 2,998,633 | 9/1961 | Andren | 29/564.4 |
| 3,086,282 | 4/1963 | Cootes et al. | 29/867 |
| 3,231,961 | 2/1966 | Andren et al. | 29/33 |
| 3,267,556 | 8/1966 | Scharf | 29/867 |
| 3,505,720 | 4/1970 | Heimbrock | 29/564.4 |
| 3,588,984 | 6/1971 | van de Kerkhof | 25/564.4 |
| 3,659,328 | 5/1972 | Klein | 29/203 D |
| 3,834,016 | 9/1974 | Loomis et al. | 29/630 A |
| 3,842,496 | 10/1974 | Mercer | 29/624 |
| 3,867,754 | 2/1975 | Koch et al. | 29/203 DS |
| 4,114,014 | 9/1978 | Shogo et al. | 219/56 |
| 4,360,962 | 11/1982 | Suzuki et al. | 29/564.4 |
| 4,363,167 | 12/1982 | Boutcher, Jr. et al. | 29/863 |

FOREIGN PATENT DOCUMENTS

| | | | |
|---|---|---|---|
| 1602907 | 8/1970 | Fed. Rep. of Germany | 408/3 |
| 57-8047 | 1/1982 | Japan . | |

*Primary Examiner*—Z. R. Bilinsky
*Attorney, Agent, or Firm*—Pollock, VandeSande & Priddy

[57] ABSTRACT

Wire stripping and crimping tools are combined in modules movable along parallel rails. An individual preparing a cable slides a particular tool module in front of a work station where each wire, requiring the same contact, is first stripped then moved to an adjacent crimper where a contact is crimped thereto. A second module carrying a second type of contact is then positioned into place and the cycle is repeated for those wires requiring fastening of the second type of contact thereto. By sequentially moving different modules to the cable, the entire cable becomes dressed in situ.

3 Claims, 2 Drawing Figures

METHOD AND APPARATUS FOR RAPIDLY STRIPPING CABLE WIRES AND CRIMPING CONTACTS THEREON

FIELD OF THE INVENTION

The present invention relates to a semi-automatic method for stripping individual wires of a cable and rapidly crimping contacts thereon.

BACKGROUND OF THE INVENTION

In many electronic applications it is necessary to strip and crimp contacts to a large number of wires, particularly in cable assemblies. Oftentimes, the cable will include differently sized wires requiring differently shaped and sized contacts to be attached to the ends thereof. Most often the crimping of contacts onto strip wires is accomplished by manually stripping the wires and then utilizing a hand-crimping tool for attaching the contacts. It is not unusual for cable assemblies to include 250–1,000 wires. As will be appreciated, the attachment of contacts by a strictly manual method is quite time consuming.

Automated wire strippers and contact crimpers do exist but their utilization in an automated procedure usually requires the movement of the cable assembly from one work station to another. With the movement of large cables this has several drawbacks, including the labor intensity of the task.

BRIEF DESCRIPTION OF THE PRESENT INVENTION

The present invention includes the improvement of wire stripping and crimping tools so that they form movable modules along parallel rails thereby allowing the individual preparing a cable to slide a particular tool module in front of a work station and strip, then crimp, contacts of a particular size to those wires in the cable. Subsequently, the operator can then simply slide a subsequent rail-mounted tool module to the same work station and repeat the process for those wires requiring contacts of a different size. The cycle is repeated at the same work station by the same operator until all the differently sized contacts are installed on the wires of a cable.

By utilizing a number of such tool modules in an assembly area, different tool operators may be positioned along the module rails and simultaneously work together thereby expediting the preparation of many cables during a period of time.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE PRESENT INVENTION

Figure 1:
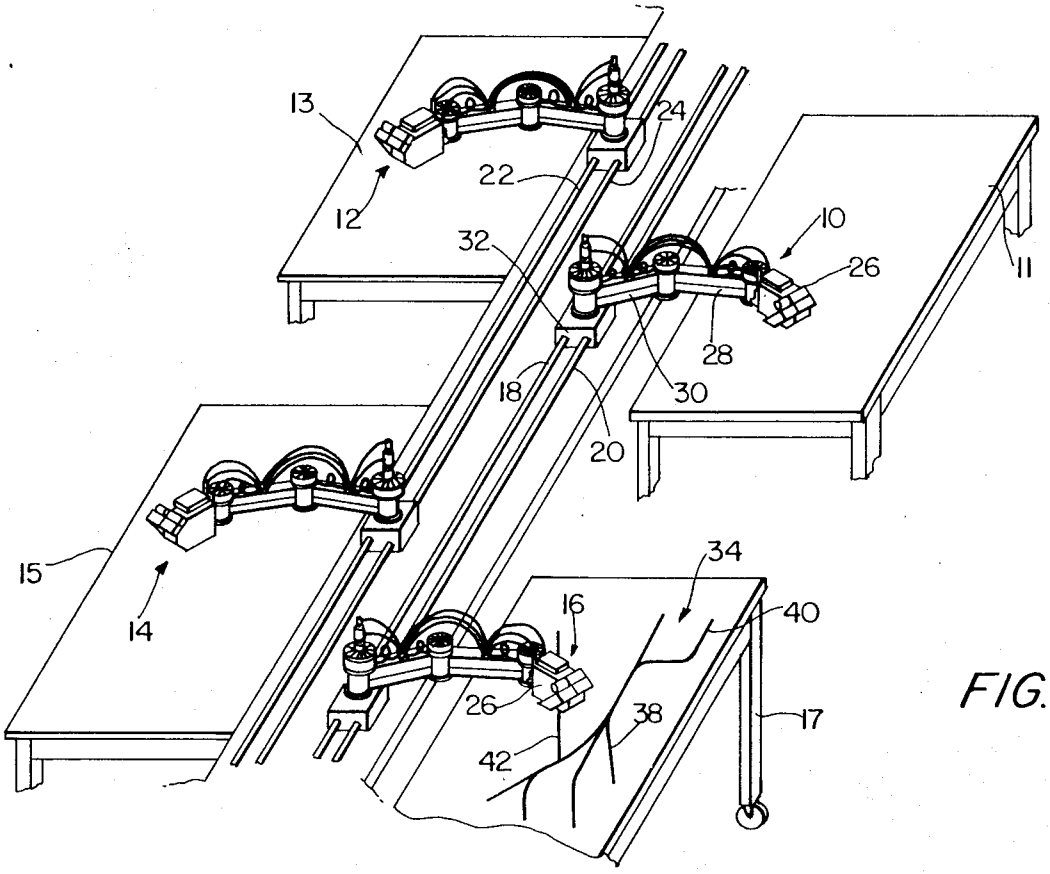
FIG. 1 is a diagram illustrating, by way of example, four tool modules located at respective work stations.

In FIG. 1, four tool modules 10, 12, 14 and 16 are shown above their respective table work stations 11, 13, 15 and 17. Each of the modules is seen to include an articulated head which includes wire stripping and contact crimping tools enabling contacts to be attached to individual wires of a cable that a module operator has positioned at his table work station as shown in connection with module 16 and its corresponding table work station 17. It is to be noted that each of the 10, 12, 14 and 16 is typically equipped with differently sized or configured contacts from the other modules, so that a bundle of wires requiring contacts of one size necessitates an articulated module to be positioned at a particular work station at one moment of time; and subsequently, when a differently sized or configured contact is to be attached to other wires of a cable, the first module is moved out of the way and a second module is moved into proper position so that those wires requiring contacts of a second type may be so equipped. The process is repeated until a cable is completely dressed.

Figure 2:
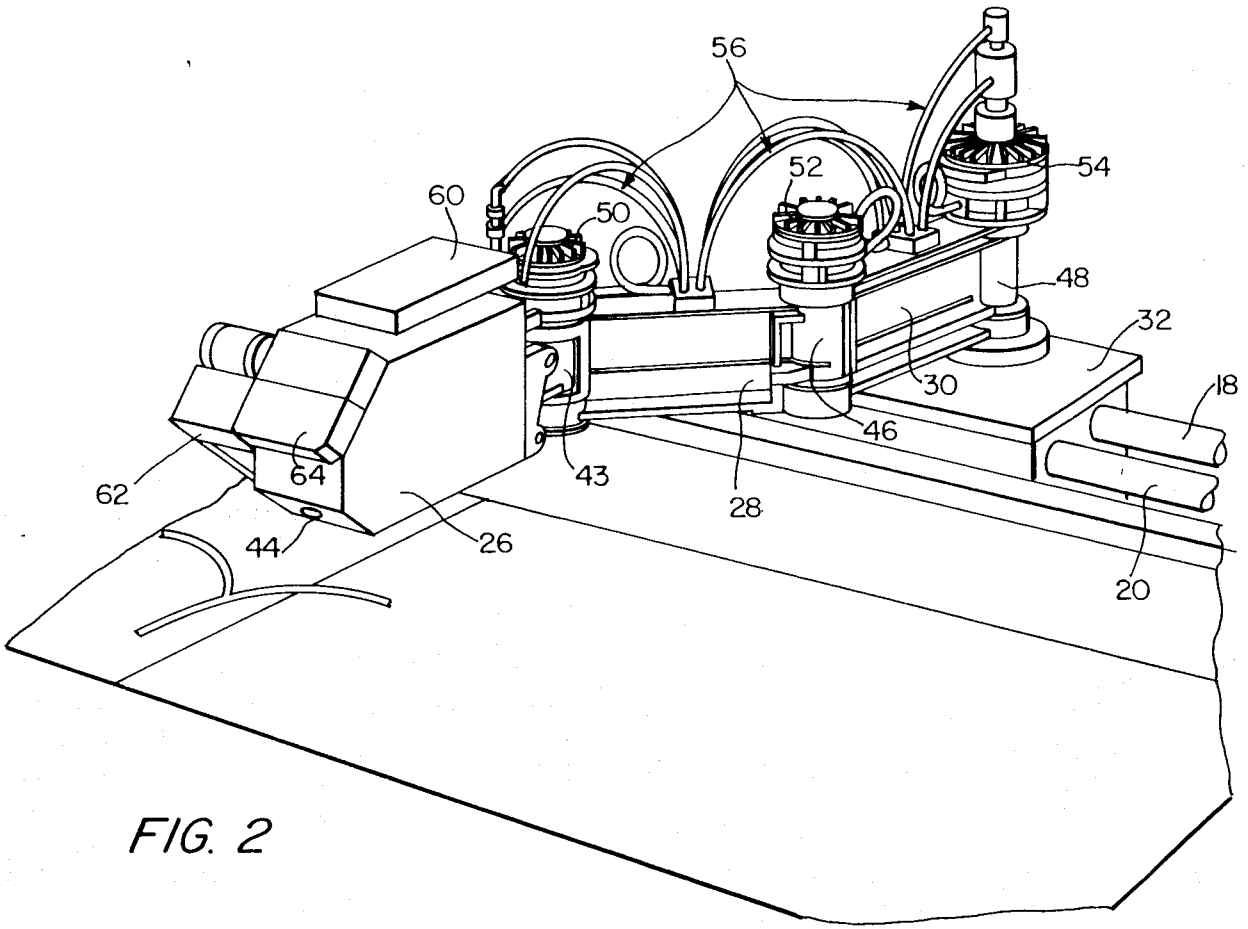
FIG. 2 is a perspective view of a single module illustrating the component parts thereof in detail.

Each module, as illustrated in FIG. 1 and to be discussed in greater detail hereinafter in connection with FIG. 2, is known in the industry as an automatic crimping tool identified as a Model ACT III, manufactured by Design, Duddy and Mercier, Inc., of Inglewood, Calif. The available module, such as module 10, includes head 26 incorporating a crimping tool which is mounted to articulated arms 28 and 30, the inward end of the articulated arm 30 being mounted to a block 32 including ball bushings that easily slide along rails 18 and 20 of a rail assembly. In fact, both modules 10 and 16 slide along rails 18 and 20 while the modules 12 and 14, shown by way of example only, are mounted to similar rails 22 and 24 of a second rail assembly.

When a cable such as 34 is positioned on a table work station such as 17, similarly color-coded wires are separated from the cable bundle as shown by 38, 40 and 42. Different contacts are to be attached to differently color-coded wires. Head 26 of the identified module is equipped with an additional wire stripper tool which, in a preferred embodiment of the invention, is manufactured by Eubanks Engineering Company of Monrovia, Calif.

Thus, if an individual operator is positioned at table work station 17, a first module 16 is moved into position over the cable 34. Next, for example, the similarly color-coded wires 42 of a cable bundle have their ends individually stripped by the stripper tool in head 26; and then each stripped wire end is inserted into a crimping tool located in head 26 where identically sized and configured contacts are automatically fed, as will be explained hereinafter, to the crimping tool located in head 26 thus enabling attachment of contacts of a preselected size to the stripped wires of a particular cable branch.

In actual utilization of the invention, after the wires 42 have been equipped with contacts of a first size, module 16 is moved away from table work station 17; and one of the other modules is moved into position over the table work station for attachment of contacts of a second size or configuration on a second bundle of wires, such as 40. Thus, the different modules are equipped with different contacts; and while a cable is positioned in situ, the individual modules are brought to the cable for attachment of the variously sized contacts to different wire bundles of the cable.

FIG. 2 illustrates a single module in greater detail.

Head 26 of the illustrated module is attached to a first articulated arm 28 by a swivel joint 43. The second arm 30 is connected to the first arm 28 by means of a second swivel joint 46. A third swivel joint 48 connects the inward end of the module to block 32 which, as previously mentioned, includes ball bushings to permit easy sliding motion of the module along rails 18 and 20.

Each of the articulated joints 43, 46 and 48 are fixed in position by respectively connected brakes 50, 52 and 54 which are of the type manufactured by the Horton Manufacturing Company, Inc., and identified as a Model TSE brake. A brake release switch 44 is provided on head 26 for releasing the pneumatically actuated brakes 50, 52 and 54 so that head 26 may freely move with respect to the articulating arms 28 and 30. When a particular module is correctly positioned over a cable on a table work station, switch 44 is set so that brakes 50, 52 and 54 lock the articulating arms 28 and 30 in a preselected position. Pneumatic drive for the brakes is provided through interconnecting pneumatic tubes 56. Then a wire from the indicated cable is fed to the wire stripper generally indicated by reference numeral 62 which is attached to head 26. After an end of the wire has been stripped, the wire is inserted into the crimping tool 64 located adjacent the wire stripper 62 on head 26. A conventional cartridge 60 of similarly sized or configured contacts is located on head 26 and the contacts are automatically fed to the crimping tool 64 as the stripped wire ends are individually positioned in the crimping tool 64. After a bundle of wires has been equipped with the contacts associated with a particular module, the module is rolled out of the way along rails 18 and 20 thereby enabling a second module to be brought into position for attachment of a second type of contact to those wires in the cable requiring such contacts. This process is repeated until all the wires of the cable are properly equipped with the selected contacts.

As will be appreciated from a review of the aforementioned description, the present invention offers an improved method and apparatus for stripping and crimping contacts to a large number of wires in a cable. This is made possible by a modification of an existing crimping tool module, whereby a wire stripping tool is mounted adjacent the crimping tool of the module so that stripping and crimping can be quickly done in side-by-side locations. Furthermore, the present invention offers an improvement over the prior art by virtue of the mounting of a plurality of such modified modules along rail assemblies thereby enabling a machine operator, positioned at a particular work station, to selectively position a plurality of modules at the work station, each module equipped with contacts of a different size or configuration.

It should be understood that the invention is not limited to the exact details of construction shown and described herein for obvious modifications will occur to persons skilled in the art.

I claim:

1. A system for securing electrical connectors to cables comprising:

at least two sets of parallel rails located in close proximity to each other;

at least one fixed work station located adjacent the rail;

a plurality of articulated tool modules, each one slidably mounted to a set of rails and positionable near the work station, each module including (a) block means located at an inward end of the module and journaled to a set of rails thereby enabling sliding motion of the module, (b) articulated arms connected between the block means and an outward positioned tool head, (c) the tool head including wire stripping means located adjacent connector crimping means, (d) means for automatically feeding contacts of a particular type to the crimping means as individual wires of the cable are manually crimped;

whereby different modules are selectively moved into operating position adjacent a cable at a work station as different connector types are to be fastened onto cable wires.

2. The work station set forth in claim 1 wherein the articulated arms are joined by pivotal joints releaseably secured together by pneumatic brake means, release of the brake means allowing free motion of the arms thereby permitting the head to be accurately located above those cable wires to which contacts are to be fastened, regardless of which set of the rails a corresponding module is mounted to.

3. The work station set forth in claim 1 together with a plurality of work stations positioned adjacent each set of rails, each station receiving a cable thereon, wherein the plurality of modules is individually moved to the station to enable contacts associated with each module to be affixed to preselected wires.

* * * * *